US012480321B2

(12) United States Patent
Mitchell et al.

(10) Patent No.: US 12,480,321 B2
(45) Date of Patent: Nov. 25, 2025

(54) PERSONAL PROTECTIVE EQUIPMENT DECONTAMINATION FACILITY IN A CONTAINER

(71) Applicants: Robert Alan Mitchell, Voorheesville, NY (US); Samuel Alan Mitchell, Voorheesville, NY (US)

(72) Inventors: Robert Alan Mitchell, Voorheesville, NY (US); Samuel Alan Mitchell, Voorheesville, NY (US)

( * ) Notice: Subject to any disclaimer, the term of this patent is extended or adjusted under 35 U.S.C. 154(b) by 207 days.

(21) Appl. No.: 18/201,438

(22) Filed: May 24, 2023

(65) Prior Publication Data

US 2024/0392592 A1 Nov. 28, 2024

(51) Int. Cl.
*E04H 1/12* (2006.01)

(52) U.S. Cl.
CPC ... *E04H 1/1277* (2013.01); *E04H 2001/1283* (2013.01)

(58) Field of Classification Search
CPC ..... E04H 1/1216; E04H 1/1277; E04H 2001/1283
See application file for complete search history.

(56) References Cited

U.S. PATENT DOCUMENTS 5,551,102 A * 9/1996 Stewart ..... E04H 1/1277 4/612
2004/0194401 A1* 10/2004 Smith ..... E04B 1/14 52/79.9
2006/0096198 A1* 5/2006 Kmet ..... E04B 1/34336 52/234
2008/0134589 A1* 6/2008 Abrams ..... E04B 1/34807 52/79.1
2009/0045195 A1* 2/2009 Djerf ..... E04B 1/34846 220/62.11
2009/0222984 A1* 9/2009 Gray ..... E04H 1/1277 4/612
2011/0041418 A1* 2/2011 Meserini ..... E04H 1/02 52/79.9
2011/0162293 A1* 7/2011 Levy ..... E04B 1/3483 52/79.9
2012/0110925 A1* 5/2012 Weber ..... E04B 1/3431 52/173.3

(Continued)

FOREIGN PATENT DOCUMENTS

GB 2264470 A * 9/1993 ..... E04H 1/02

*Primary Examiner* — Christine T Cajilig
(74) *Attorney, Agent, or Firm* — FALATI

(57) ABSTRACT

A decontamination facility for personnel and personal protective equipment (PPE) is disclosed. The decontamination facility comprises shipping containers that includes: decontamination and laundering equipment, one or more personnel showers, doors, a heating, ventilation and air conditioning (HVAC) system, a hot water heater, and a riser system. The doors are sized to allow the decontamination and laundering equipment to pass through easily. The heating, ventilation and air conditioning (HVAC) system is configured to provide a clean, climate-controlled, atmosphere inside the container. A riser system can be attached to the bottom of one or more corner supports to create a crawl space beneath the container, and the crawl space houses a wastewater collection and removal system, a tank, and an ejector pump to push wastewater to a sewer or septic system.

14 Claims, 9 Drawing Sheets

(56) References Cited

U.S. PATENT DOCUMENTS

| | | | | |
|---|---|---|---|---|
| 2012/0251388 | A1* | 10/2012 | Case, III | B60P 3/005 422/119 |
| 2014/0259995 | A1* | 9/2014 | White | E04H 9/16 52/173.1 |
| 2017/0156961 | A1* | 6/2017 | Patel | E04H 1/1205 |
| 2023/0087534 | A1* | 3/2023 | Cook | E04H 1/1266 52/79.1 |

* cited by examiner

PERSONAL PROTECTIVE EQUIPMENT DECONTAMINATION FACILITY IN A CONTAINER

BACKGROUND OF THE INVENTION

In 2020, the National Fire Protection Association (NFPA) estimated that there are approximately 1,041,000 firefighters in the United States, 65% of whom are volunteers. In 2018, firefighters in the US responded to 36,746,500 calls. There are approximately 29,500 fire departments in the US. Sixty percent of these departments also provide basic life support, 40% provide Emergency Medical Services (EMS), and 21% provide ambulance services.

Firefighters or people assisting at the fire scene are exposed to significant quantities of toxic and carcinogenic compounds in the course of their work. The compounds include phthalates, brominated flame retardants, organophosphate esters, polycyclic aromatic hydrocarbons (PAH), and per- and polyfluoroalkyl substances (PFAS), among others. All of these have been linked to an increased incidence of certain cancers, as depicted in FIG. 1.

According to studies by the National Institute of Occupational Safety and Health (NIOSH) and other agencies, firefighters have a 9 percent higher risk of being diagnosed with cancer and a 14 percent higher risk of dying from the disease than the general adult U.S. population. FIG. 1 shows a chart 10 illustrating an additional risk of cancer disease among firefighters. Numerous studies have concluded that cancer is the number one cause of death among firefighters, and that in North America, cancer caused 66% of the career firefighter line-of-duty deaths between 2002 and 2019. In 2022, the International Agency for Research on Cancer (IARC), the cancer agency of the World Health Organization (WHO), has re-evaluated firefighting and classified firefighting occupational exposure as a group 1 carcinogen, their highest rating, stating there is sufficient evidence for cancer in humans.

Volunteer firefighters face an increased likelihood of exposing their family members to carcinogenic compounds. This is because many of them respond directly to the fire in their own vehicles, contaminating their vehicles by exposure to the airborne combustion byproducts and by placing their contaminated Personal Protective Equipment (PPE) in their vehicles. Additionally, they are more likely to arrive home carrying these compounds on their clothing, skin, and hair.

A recent study by the Kitsap County, Washington Fire Rescue Department even suggests that there is a heightened risk of cancer being passed down to the children of firefighters. The report states, "A child of a Kitsap County career firefighter has a 0.49% chance of getting cancer. This probability is 27.4 times higher than that of the general population of children. Put another way, the child of a Kitsap County firefighter is 27 times more likely to be diagnosed with cancer than a child in the general population of children." (Cancer Rates in Children of Kitsap Count Firefighters, Ronald E. Powers, 2016).

To reduce the risk to firefighters of developing cancer, it is important to reduce their exposure to these hazardous chemicals by minimizing their time and amount of exposure, both respiratory and dermal. Although a preliminary "wash down" should occur at the fire scene, a significant responsibility is promptly and thoroughly decontaminating both their PPE and their bodies. The target location for this to happen is in a decon/laundry facility at the fire station.

Firefighter personnel, PPE and equipment returning to the fire station are contaminated with carcinogens. Studies show that these carcinogenic particles can be found in most areas within a fire station. To avoid this, it is important to handle contaminated gear in a safe and regulated manner and to provide thorough cleaning and decontamination of the PPE, equipment and firefighters in an area isolated from the living and administrative spaces of the station.

There are approximately 52,000 fire stations in the United States. In 2015 (updated in 2019), the National Fire Protection Association (NFPA) did a comprehensive study of the condition of fire stations in the United States. They found that "an estimated 44 percent of fire stations are over 40 years old. Smaller departments are somewhat more likely to have older stations, but many large departments have older stations as well." The cost of renovating or replacing these stations was determined to be $70 to $100 billion (Matthew Foley. Renovation Needs of the US Fire Service. July 2019).

At least 90% of the existing stations (47,000) do not have decontamination laundries. Most of them lack space within the station and will require an addition. Adding a building to a fire station is a complex process that may involve public referenda to approve long-term debt, planning and zoning approvals, architectural and engineering services, construction bidding involving multiple prime contracts, and construction administration. Completing all these steps can take years.

Of the 29,500 fire departments, 80% serve communities with populations below 10,000. These communities probably are unable to afford the cost of replacing their fire station, or even conventionally building an addition to accommodate a decontamination laundry, due to their small tax base. A less expensive method to provide a decon/laundry is essential. Firefighters are not the only people who risk this type of exposure. These same issues apply for emergency medical responders who are active at building and vehicle fires, and some industrial workers.

A business with employees exposed to carcinogens may be reluctant to incur the costs of constructing a facility to protect their employees. They might decide that it can be more cost effective to pay fines than build facilities, especially if that facility may only be needed temporarily. However, an affordable, portable, and rapidly deployed decontamination facility that can be used across a variety of industries will address this directly. There is a pressing need for a standalone decontamination facility for personnel and personal protective equipment (PPE) that offers several advantages over existing options.

SUMMARY OF THE INVENTION

Decon in a Box (D.I.B) is a decontamination facility for personnel and personal protective equipment (PPE). It provides a portable platform fabricated from a modified ISO shipping container that is a fully customizable decontamination facility for public safety and industrial workers who utilize reusable PPE.

The present disclosure provides for a standalone decontamination facility for personnel and personal protective equipment (PPE) that offers several advantages, including reduced time required to implement, adaptability, scalability, and design customization and flexibility, factory manufacturing quality control, portability, transportability to remote locations, cost-effectiveness, and one that treats a wide range of decontamination situations.

The present disclosure discloses a decontamination facility for personnel and personal protective equipment (PPE). The decontamination facility comprises one or more containers that includes: decontamination and laundering equipment, a shower, doors, a heating, ventilation and air conditioning (HVAC) system, a water heater, a wastewater capture system, and a structural riser system. The doors are sized to allow the decontamination and laundering equipment to pass through easily. The heating, ventilation and air conditioning (HVAC) system is configured to provide a clean, climate controlled, atmosphere inside the container. The HVAC system is equipped with heat recovery fresh air supply and a recirculating air filtration system. The riser system is attached to the bottom of one or more corner supports to create a crawl space beneath the container, and the crawl space houses a wastewater collection and removal system, a tank, and an ejector pump to push wastewater to a sewer or septic system.

In one embodiment, the containers are one or more new or used shipping containers. The shipping containers are installed either permanently or temporarily. In another embodiment, the containers are installed directly on a masonry foundation with a crawlspace and an access door. In one embodiment, the riser system with a riser is configured to be stronger than the container, and reinforced against lateral forces that occurs during transit and installation.

In one embodiment, the riser utilizes intermodal standards that allows the container or the conjoined system of the container and riser to be stackable and shipped via rail. The riser contains an access hatch for performing maintenance and repair activities. The riser and the container can be configured to provide support for external insulation, sheathing and roof system, or can be insulated and finished on the interior leaving the exterior surface of the of the container to be the exterior surface of the decontamination facility.

In one embodiment, the container is fully wired to accommodate and power the decontamination and laundering equipment, one or more lights, and HVAC, and wherein the wires are connected through a waterproof service panel for electrical supply. The container is further fully plumbed to accommodate the decontamination and laundering equipment, thereby providing water service through a water service fitting.

In one embodiment, the wastewater collection and removal system is comprised of piping sized to create a drainage reservoir that is commensurate with the maximum expected outflow of water from the facility. The pipes are installed along an interior perimeter of a space of the riser directly below a floor of the container. In one embodiment, the pipes are plumbed through the floor to provide access to the decontamination and laundering equipment and drain into the tank fitted with the ejector pump that allows the wastewater to be pumped to the sewer or septic system through a wastewater service fitting.

One aspect of the present disclosure is directed to a decontamination facility for personnel and personal protective equipment (PPE), comprising one or more containers, wherein each container comprises: one or more pieces of decontamination and laundering equipment; a shower; one or more doors, wherein the doors are sized to allow the decontamination and laundering equipment to pass through easily; a hot water heater; and a heating, ventilation and air conditioning (HVAC) system with heat recovery fresh air supply and a recirculating air filtration system, configured to provide a clean, climate controlled, atmosphere inside the container. In one embodiment, said decontamination facility further comprises a riser system that is attached to the bottom of one or more corner supports to create a crawl space beneath the container, wherein the crawl space houses a wastewater collection and removal system, a tank, and an ejector pump to push wastewater to a sewer or septic system.

In one embodiment, the containers are shipping containers, wherein the shipping containers are installed either permanently or temporarily. In one embodiment, the containers are installed directly on a masonry foundation with a crawlspace and an access door. In another embodiment, the riser system is reinforced against lateral forces that occurs during transit and installation. In one embodiment, the riser is engineered against lateral forces that occurs during transit and installation. In a related embodiment, the riser utilizes intermodal standards that allows the container or conjoined system of the container and riser to be stackable and/or shippable via rail. In another related embodiment, the riser comprises an access hatch for performing maintenance and repair activities. In one embodiment, the riser and the container are configured to provide support for external insulation, sheathing and roof system. In one embodiment, the riser and the container are insulated and finished on the interior leaving the exterior surface of the of the container to be the exterior surface of the decontamination facility.

In one embodiment, the container is a pre-existing shipping container, wherein one or more doors in the pre-existing shipping container are permanently closed by welding and removing one or more hinges and locking devices. In one embodiment, the container is fully wired to accommodate and power the decontamination and laundering equipment, one or more lights, and HVAC, and wherein the wires are connected through a waterproof service panel for electrical supply. In another embodiment, the container is fully plumbed to accommodate the decontamination and laundering equipment, thereby providing water service through a service fitting. In one embodiment, the wastewater collection and removal system is comprised of piping sized to create a drainage reservoir that is commensurate on the maximum expected outflow of water from the facility. In one example, the diameter of the pipe is between eight and ten inches.

In one embodiment, the pipes are installed along an interior perimeter of a space of the riser directly below a floor of the container. In a related embodiment, the pipes are plumbed through the floor to provide access to the decontamination and laundering equipment, and drain into the tank fitted with the ejector pump that allows the wastewater to be pumped to the sewer or septic system. In one embodiment, the floor comprises one or more drains connecting the wastewater removal system and an entire drainage system. In one embodiment, the container is fully plumbed to accommodate the decontamination and laundering equipment, thereby providing water service through a water service fitting. In another embodiment, the wastewater collection and removal system is comprised of piping sized to create a drainage reservoir that is commensurate on the maximum expected outflow of water from the facility.

In one embodiment, the floor is waterproofed with a multi-layered system to ensure its longevity. In another embodiment, one container is attached to another container by using guides and fasteners, thereby allowing them to easily mate up and align with each other ensuring a secure connection.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DETAILED DESCRIPTION

Figure 1:
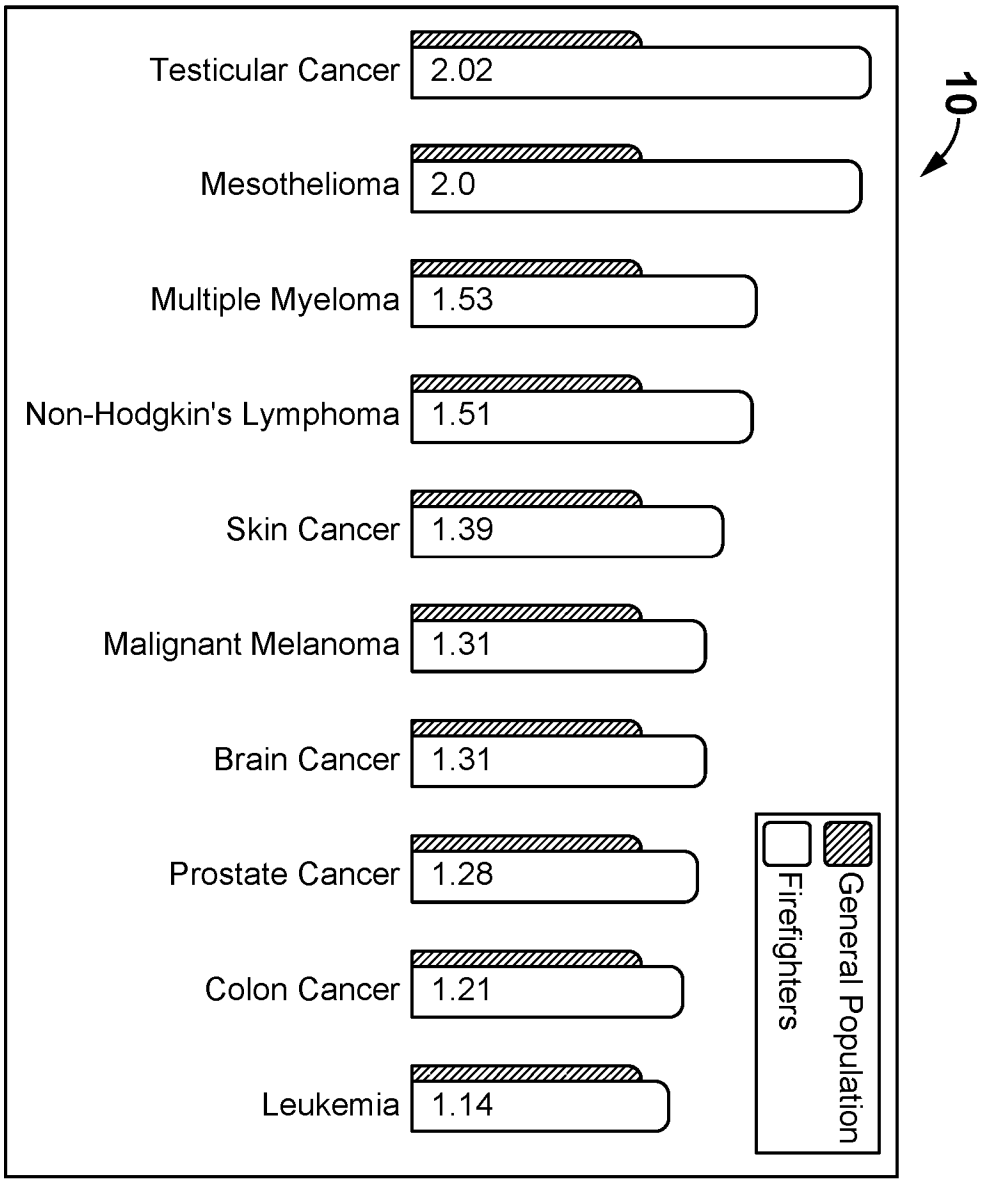
FIG. 1 (PRIOR ART)
FIG. 1 exemplarily illustrates a chart showing additional risk of cancer disease among firefighters.

The present disclosure generally relates to a decontamination facility for personnel and personal protective equipment (PPE).

A description of embodiments of the present disclosure will now be given with reference to the figures. It is expected that the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

Before any embodiments of the invention are explained in detail, it is to be understood that the disclosure is not limited in its application to the details of construction nor to the arrangement of components set forth in the following description or illustrated in the drawings. The disclosure is capable of other embodiments and of being practiced or of being carried out in various ways.

Figure 2:
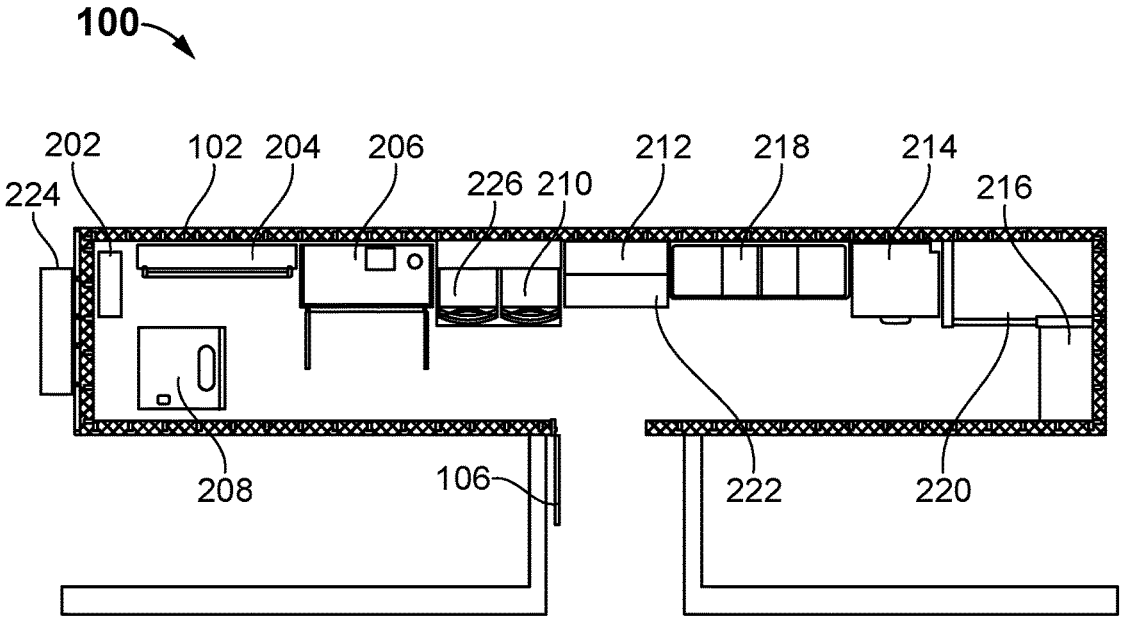
FIG. 2 exemplarily illustrates one possible floor plan of the decontamination facility in a container, according to an embodiment of the present disclosure.
Figure 3:
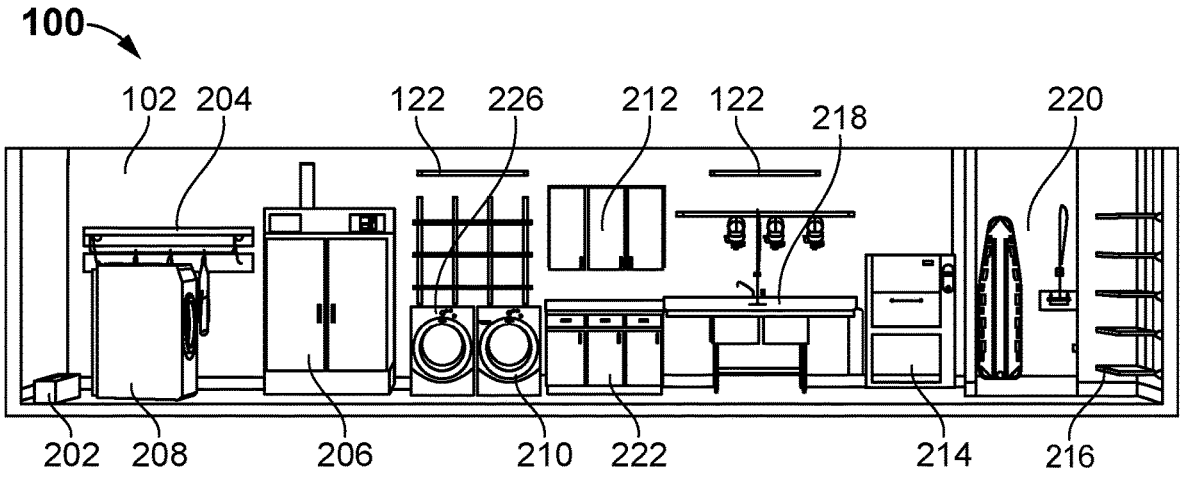
FIG. 3 exemplarily illustrates an interior elevation view of the decontamination facility in a container, according to an embodiment of the present disclosure.
Figure 4:
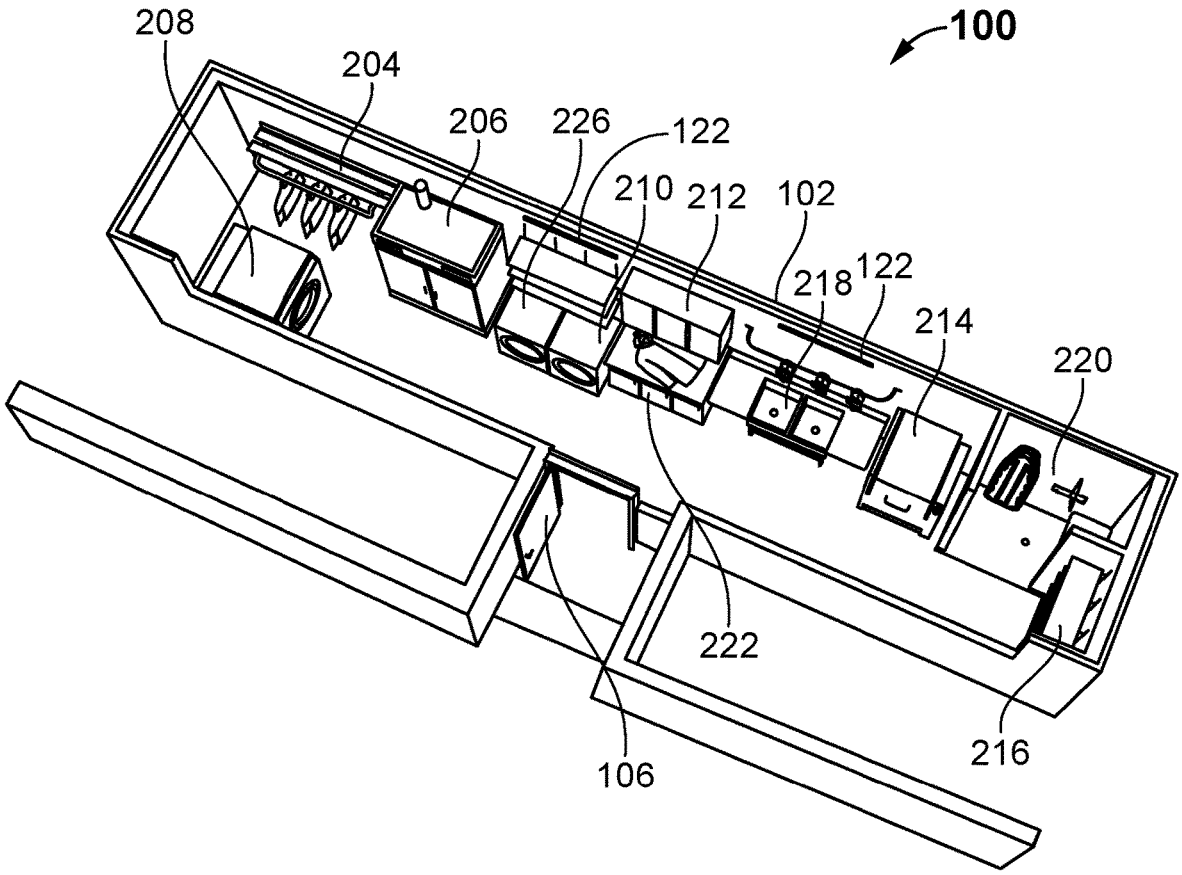
FIG. 4 exemplarily illustrates an axonometric view of the decontamination facility in a container, according to an embodiment of the present disclosure.
Figure 5A:
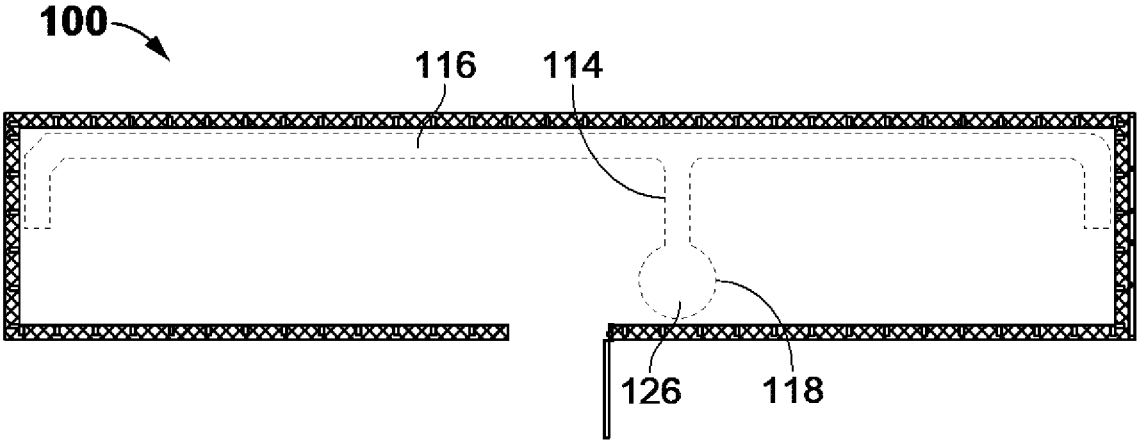
FIG. 5A-5D exemplarily illustrates various views of the decontamination facility in a container with riser base, according to one embodiment of the present disclosure.
Figure 5B:
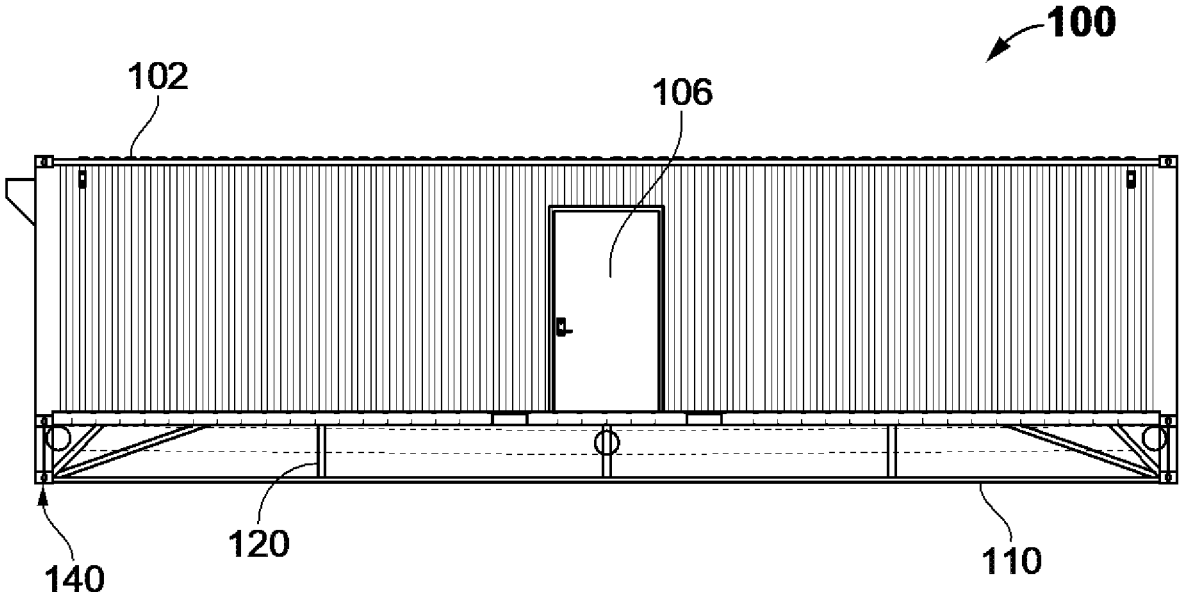
Figure 5C:
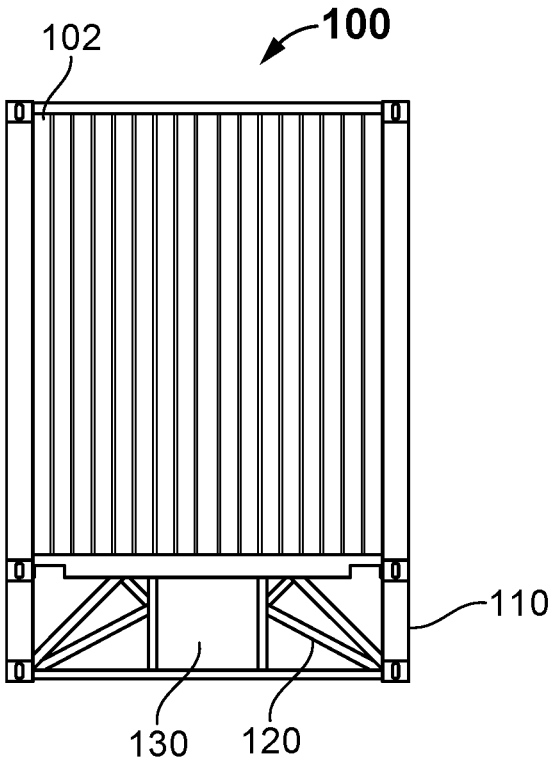
Figure 5D:
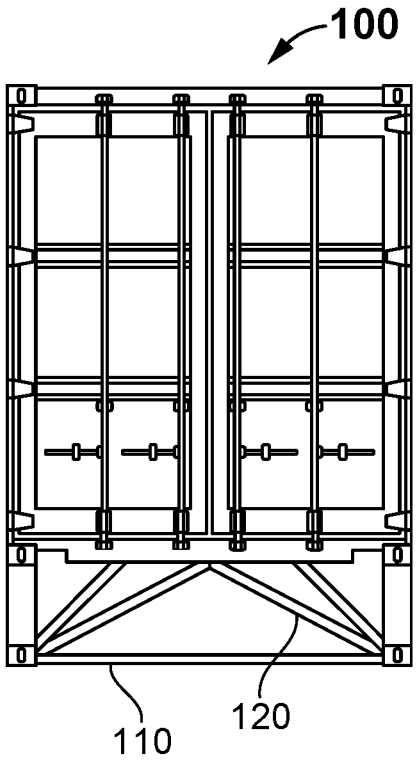

Referring to FIGS. 2-4, a floor plan of the decontamination facility in a container 102 according to one embodiment, is disclosed. The present disclosure discloses a decontamination facility 100 for personnel and personal protective equipment (PPE). The decontamination facility 100 comprises one or more containers 102 that includes: decontamination and laundering equipment 204, 206, 208, 210, 214, and 226, doors 106, a heating, ventilation and air conditioning (HVAC) system 224, hot water heater 202, and a riser system 110 (shown in FIGS. 5A-5D). The doors 106 are sized to allow the decontamination and laundering equipment 204, 206, 208, 210, 214 and 226 to pass through easily. The heating, ventilation and air conditioning (HVAC) system 224 is configured to provide a clean, climate-controlled, atmosphere inside the container 102. The HVAC system 224 is equipped with heat recovery fresh air supply and a recirculating air filtration system. The water heater 202 comprises a storage vessel adapted to store water at a comparatively low temperature and a heating element to heat the outflowing stored water to a desired higher temperature.

In some embodiments, the decontamination facility 100 may comprise one or more containers 102 that includes: HVAC unit 224, hot water heater 202, gear air drying rack 204, turnout gear dryer 206, PPE washer/extractor 208, washer 226, dryer 210, wall cabinet 212, SCBA washer 214, shelving 216, sink 218, shower 220 and base cabinet 222. In some embodiments, the container 102 may be a high cube cargo container. The container 102 may be in different dimensions to install all above components or personal protective equipment conveniently. Further, one container may be attached to another container to create alternative arrangements of equipment.

Referring to FIGS. 5A-5D, various views of the decontamination facility 100 in a container 102 with riser system 110, according to one embodiment is disclosed. The riser system 110 is attached to the bottom of one or more corner supports to create a crawl space 112 (shown in FIG. 6) beneath the container 102, and the crawl space 112 (shown in FIG. 6) houses a wastewater collection and removal system 114, a tank 116, and an ejector pump 118 to push wastewater to a sewer or septic system 126. In one embodiment, the riser 120 utilizes intermodal standards and standard intermodal container corner block 140 that allows the container 102 or the conjoined system of container 102 and riser 120 to be stackable and shipped via rail. The riser 120 further has an access hatch or door 130 for performing maintenance and repair activities. The riser 120 and the container 102 are configured to provide support for either external or internal insulation, sheathing and roof system.

In some embodiments, the wastewater collection and removal system 114 is comprised of piping sized to create a drainage reservoir that is commensurate with the maximum expected outflow of water from the facility. In one example, the wastewater collection and removal system 114 comprises piping that has a diameter of 8-12 inches. The pipes are installed along an interior perimeter of the crawl space 112 of the riser 120 directly below a floor 124 (shown in FIG. 7) of the container 102. In one embodiment, the pipes are plumbed through the floor 124 (shown in FIG. 7) to provide access to the decontamination and laundering equipment 204, 206, 208, 210, 214, and 226, and drain into the tank 116 fitted with the ejector pump 118 that allows the wastewater to be pumped to the sewer or septic system 126.

Figure 6:
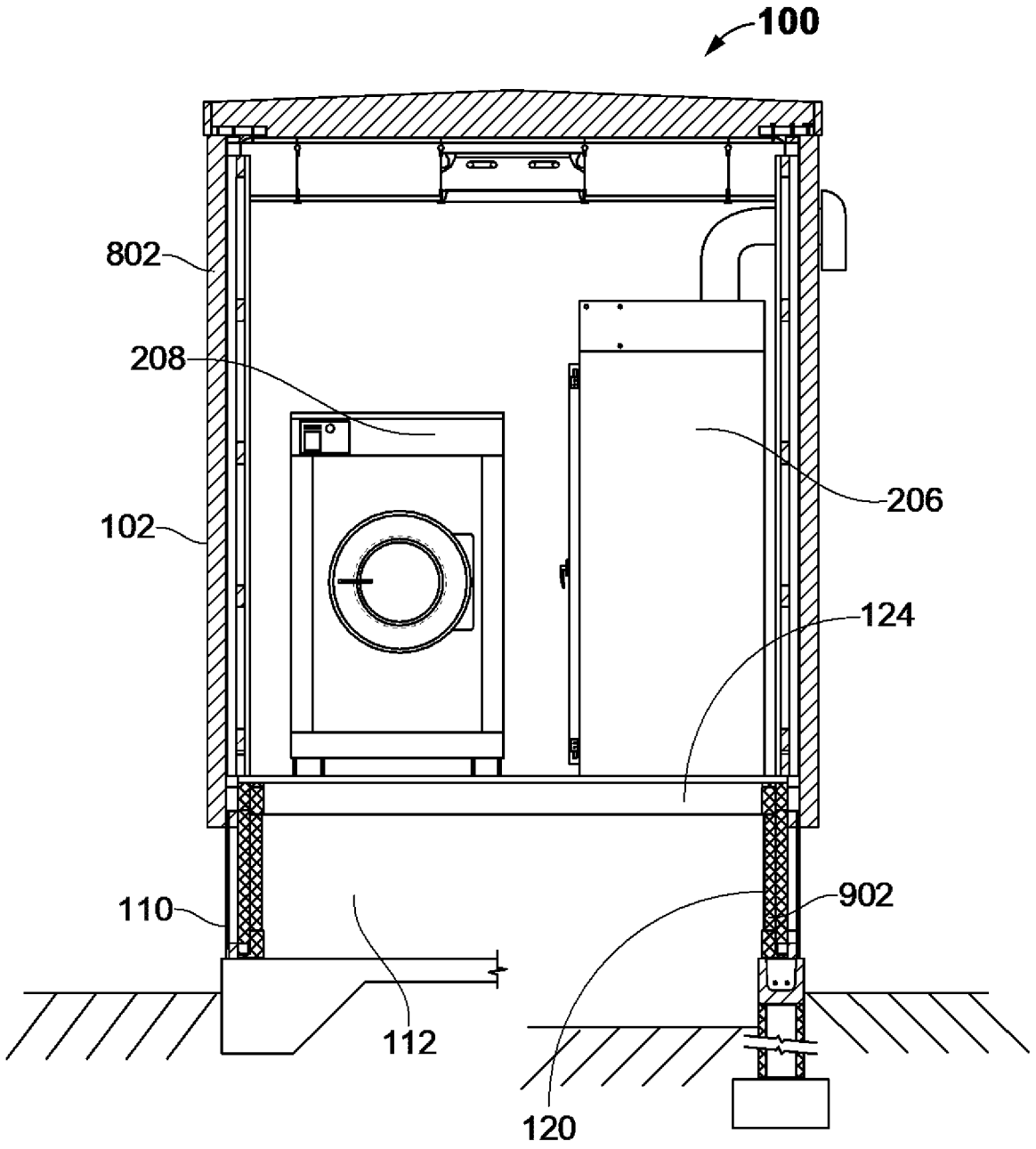
FIG. 6 exemplarily illustrates a transverse sectional view of the decontamination facility in a container with exterior insulations and finish system (EIFS), according to one embodiment of the present disclosure.

Referring to FIG. 6, a transverse sectional view of the decontamination facility in a container 102 with exterior insulations and finish system (EIFS), according to one embodiment is disclosed. In one embodiment, the containers 102 are shipping containers. The shipping containers 102 are installed either permanently or temporarily. In another embodiment, the containers 102 are installed directly on a masonry foundation with the crawl space 112 and an access door 130. In one embodiment, the riser system 110 with a riser 120 is reinforced against lateral forces that occurs during transit and installation. The container 102 can be installed directly on the masonry foundation with the masonry foundation creating the crawl space, eliminating the need for the riser 120.

In one embodiment, the container 102 is a pre-existing shipping container, wherein one or more doors 106 in the pre-existing shipping container are permanently closed by welding and removing one or more hinges and locking devices. The container 102 is fully wired to accommodate and power the decontamination and laundering equipment 204, 206, 208, 210, 214 and 226, one or more lights 122 (shown in FIG. 4), and HVAC 224, and the wires are connected through a waterproof service panel for electrical supply. The container 102 is further fully plumbed to accommodate the decontamination and laundering equipment 204, 206, 208, 210, 214 and 226, thereby providing water service through a service panel. In some embodiments, the container 102 may include a PPE drying cabinet vent.

Referring to FIG. 6, the container 102 may include a membrane roofing over rigid insulation on the container steel roof. The roofing and fascia are connected by angles and wood outrigger. Further, the side wall of the container 102 may also include an exterior insulating and finish system (EIFS) 802 such as a rigid foam insulation, with an interior such as gypsum drywall, and a fiberglass reinforced polyester (FRP), or the steel of the container can be left exposed as the interior finish. In one embodiment, the container may be incorporated anywhere or wherever required, by using concrete foundation with a foundation slab (depth and reinforcement as needed) and corner post. The corner post may also include a rigid exterior skin and foam insulation 902.

Figure 7:
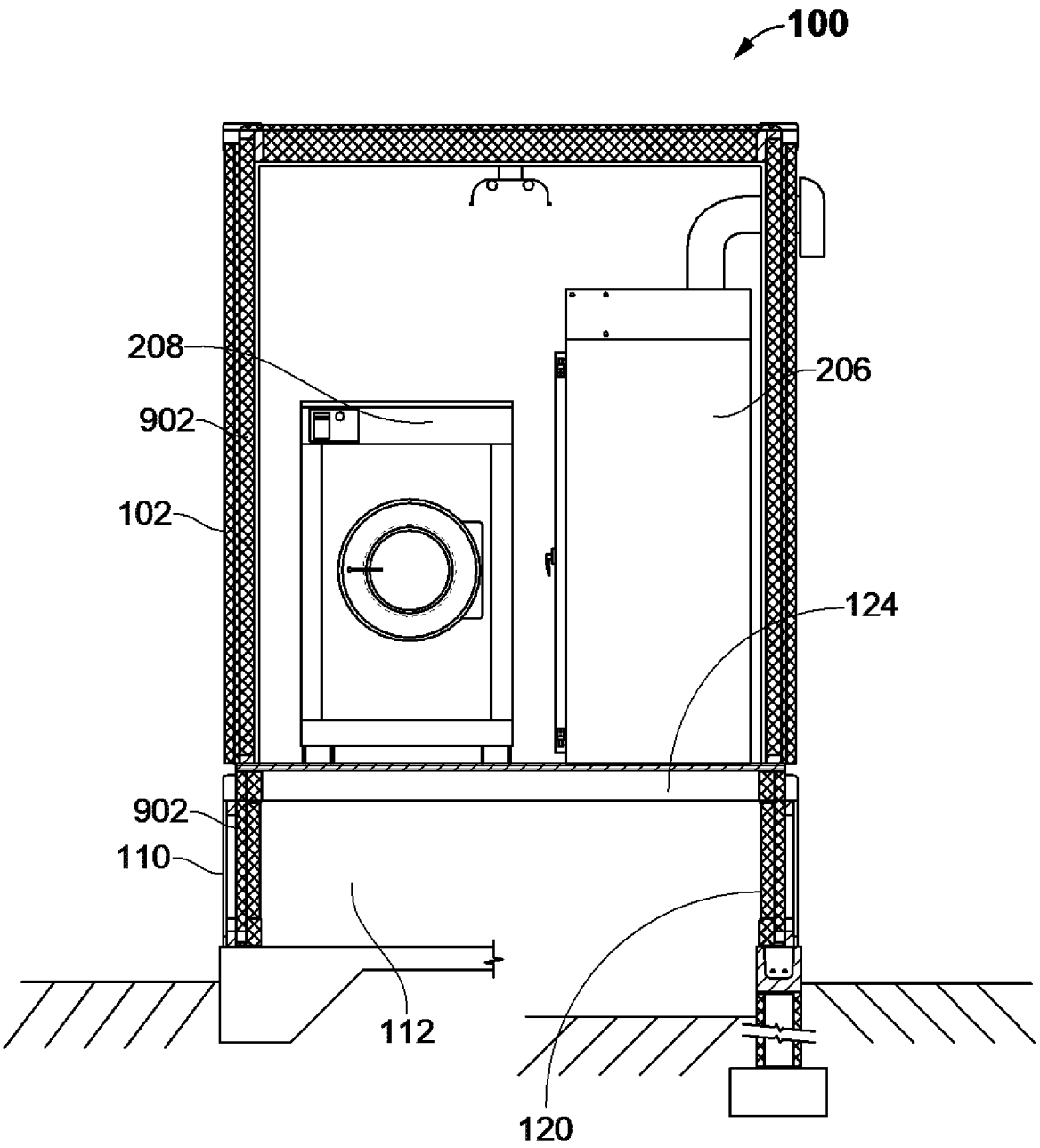
FIG. 7 exemplarily illustrates a transverse sectional view of the decontamination facility in a container with internally installed insulation, according to one embodiment of the present disclosure.

Referring to FIG. 7, a transverse sectional view of the decontamination facility in a container 102 with internally installed insulation, according to one embodiment is disclosed. In one embodiment, the floor 124 comprises one or more drains connecting the wastewater removal system and an entire drainage system 114. In another embodiment, the floor 124 is waterproofed with a multi-layered system to ensure its longevity. In some embodiments, the container 102 may include a liquid applied membrane roofing on a container steel roof, and spray foam insulation 902 under the container steel roof. Further, the side wall of the container 102 may also include a spray foam insulation, a gypsum drywall, and a fiberglass reinforced polyester (FRP).

Figure 8:
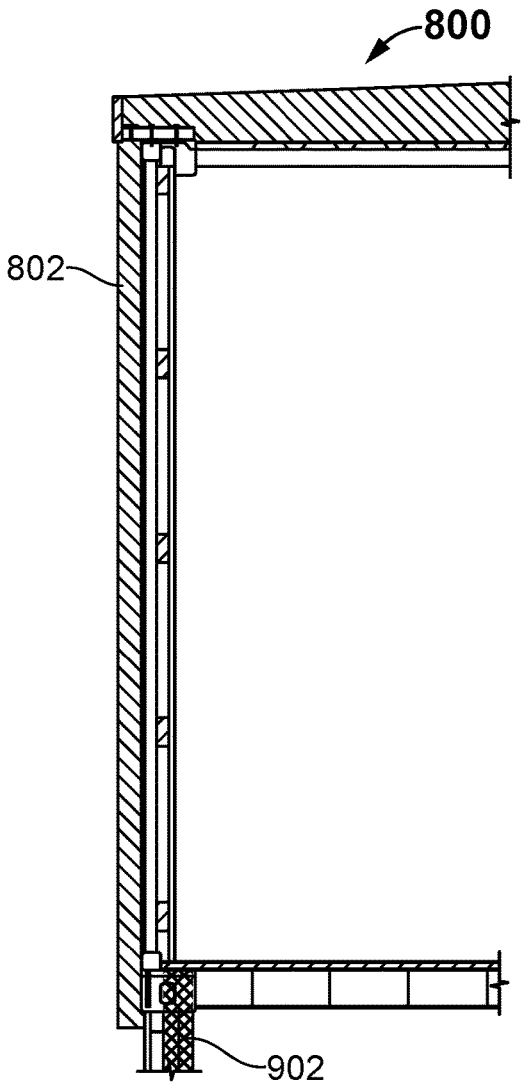
FIG. 8 exemplarily illustrates an end section showing exterior insulations and finish system (EIFS), according to one embodiment of the present disclosure.
Figure 9:
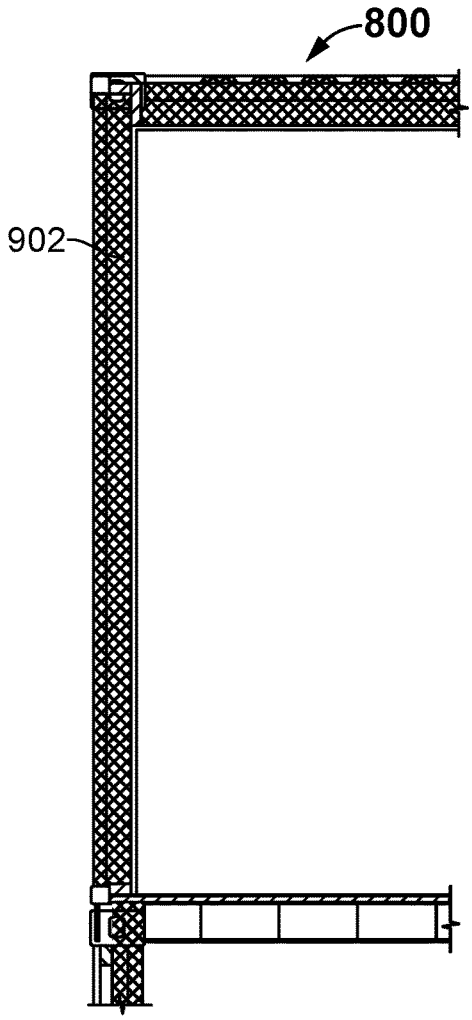
FIG. 9 exemplarily illustrates an end section showing internally installed insulation, according to one embodiment of the present disclosure.
Figure 10:
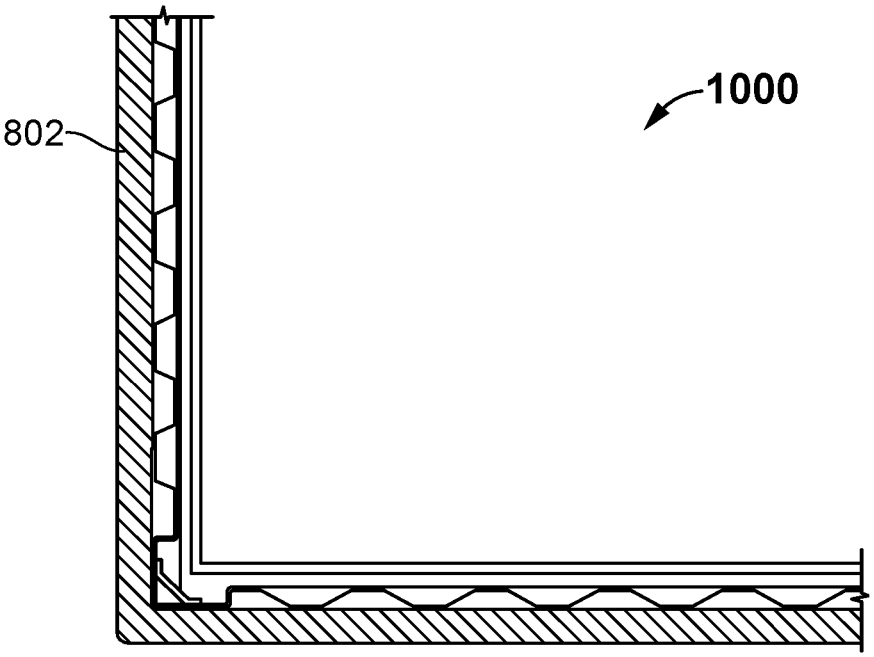
FIG. 10 exemplarily illustrates a horizontal section showing exterior insulations and finish system (EIFS), according to one embodiment of the present disclosure.
Figure 11:
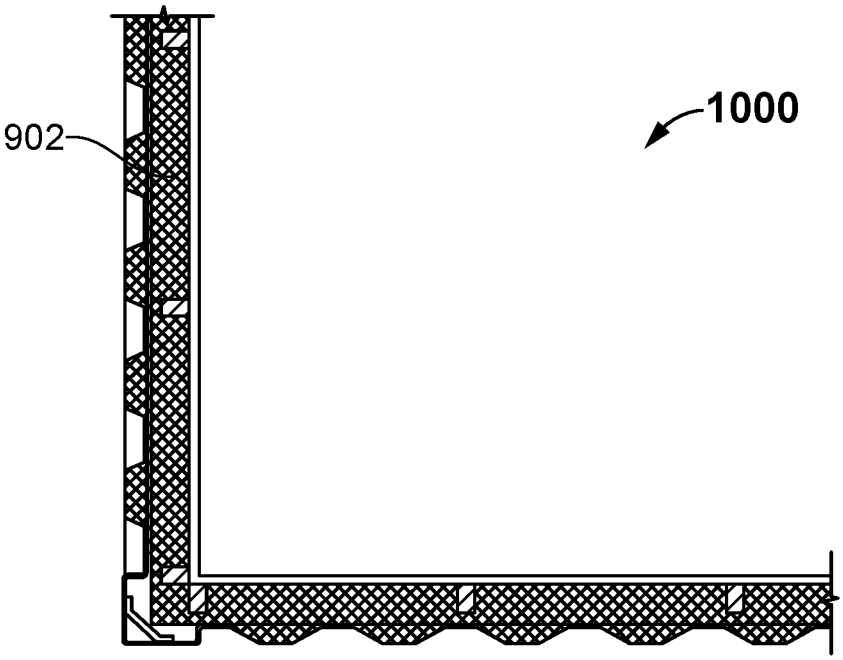
FIG. 11 exemplarily illustrates a horizontal section showing internally installed insulation, according to one embodiment of the present disclosure.

Referring to FIG. 8, an end section 800 showing exterior insulations and finish system (EIFS) 802, according to one embodiment are disclosed. Referring to FIG. 9, an end section 800 showing internally installed foam insulation 902, according to one embodiment is disclosed. Further, the corner post of the riser system 110 includes foam insulation 902. Referring to FIG. 10, a horizontal section 1000 showing exterior insulations and finish system (EIFS) 802, according to another embodiment are disclosed. Referring to FIG. 11, a horizontal section 1000 showing internally installed foam insulation 902, according to another embodiment is disclosed.

Advantageously, the decontamination facility 100 for personnel and personal protective equipment (PPE) can also be used on a temporary basis, where future construction will either modify or replace the current, deficient facility. The decontamination facility 100 for personnel and personal protective equipment (PPE) can be relocated to a different facility that has not yet been upgraded. The decontamination facility 100 for personnel and personal protective equipment (PPE), significantly helps to solve the critical health risk problem such as, extremely high cancer rates experienced by firefighters, other first responders, and industrial workers. These cancer rates can be reduced by properly decontaminating the PPE used by these workers. The vast majority of existing fire stations and other related facilities do not have proper spaces and equipment for the needed decontamination, and many of these facilities do not have even space available within the facility to house the decontamination equipment. It is essential to provide a simple, straightforward, and economical personnel and PPE decontamination means, for the first responders and industrial workers.

Further, there are many advantages of this decontamination facility 100 for personnel and personal protective equipment (PPE) over traditional decontamination facilities: Advantages of (1) time savings, (2) proper design, (3) quality control, (4) adaptability and portability, (5) scalability, (6) flexibility, (7) transportability to remote locations, (8) cost, and (9) complete range of treatment and ready availability.

The advantage of time savings. Any existing decontamination facility (prior existing technology) is the result of a brick-and-mortar construction project. These require: (a) A design process likely involving an architect and engineers. The facility owner will need to advertise for, interview, and contract with design professionals to create the construction documents and provide construction administration services. Very few design professionals are experienced in the issues of decon/laundries and will need time to learn the subject before designing a proper facility, or alternatively, they will develop an improper design. (b) Local municipality construction approval. Especially if the facility requires an addition to the existing building. Planning Board approval, Health Department approval, and Building Department approvals rarely takes less than three months, and often, much longer. (c) Voter approval may be required for brick-and-mortar construction, depending on laws of the state in which the facility is located. (d) A construction bidding process, that may involve mandated separate contracts each trade, as is the case in New York State and Massachusetts. Requiring separate sub-contractors at the construction site introduces delays since the completion of a task by contractor A has no bearing on the availability of contractor B to arrive at the site when contractor A has completed the work requisite for contractor B to start. In construction, time is money. (e) Weather and supply chain delays in the construction process. The current construction market and labor shortages are extending the time required for brick-and-mortar projects by up to 50%. It is important to solve the problem of worker contamination as quickly as possible, and all the issues described above will significantly increase the amount of time that it will take to construct a brick-and-mortar facility, compared to deploying the container 102 according to the present invention.

The advantage of proper design: If a facility owner hires a local architect and engineer to design decon/laundry, it is likely that the local designer will not have sufficient knowledge and experience to produce a safe and efficient design. This leaves the workers at greater risk since they may have the mistaken impressions that having their new facility means they are safe.

The advantage of quality control: The fabrication of the containers 102 will occur in a climate-controlled assembly facility with all parts and pieces inventoried onsite. This feature contrasts with the task of constructing a brick-and-mortar facility with multiple trades during an era rife with labor shortages, multiple suppliers of components that may not be at site when needed, improper storage of construction materials, poor workmanship, and variable weather conditions. Additionally, the design professional available to the facility owners are likely to be inexperienced in decon/laundry design, and are likely to overlook important design matters, and not notice mistakes made by the contractors.

The advantage of adaptability and portability allows for a wider range of potential locations for placement. It can be delivered using conventional logistics, relocated as needed, and it can be modified to address many different needs while remaining portable.

The advantage of scalability: The containers 102 related to the present invention, can be joined at the sidewall or the end wall, as well as stacked.

The advantage of flexibility: The containers 102 related to the present invention, can be attached directly to a preexisting building or stand alone. It can be used temporarily while waiting for a building to be constructed, and then relocated to another site.

The advantage of transportability to remote locations: The containers 102 related to the present invention, can be delivered by "heavy lifting" helicopter. This makes it a viable option for deployment to remote locations and disaster sites inaccessible to conventional logistics.

The advantage of cost: The cost-effective nature of fabricating the containers 102 according to the present invention, allows it to be purchased by a greater number of companies, bringing a higher standard of decontamination to a greater number of individuals.

The advantage of complete range of treatment and ready availability: Existing truck mounted mobile decontamination devices, can only offer an incomplete array of the needed equipment and services due to the very nature of their being truck mounted. Furthermore, they are provided as a service from a limited number of vendors that need to be driven to the fire scene or station when required. There could never be an adequate number of vendors to be able to reach even a miniscule percentage of the 52,000 stations in the short time required, especially when considering the need to have a decontaminating shower within one hour of return to the station. The containers 102 according to the present invention, will be available at the station for immediate use.

The foregoing description comprises illustrative embodiments of the present disclosure. Having thus described exemplary embodiments of the present disclosure, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method.

Many modifications and other embodiments of the disclosure will come to mind to one skilled in the art to which this disclosure pertains having the benefit of the teachings presented in the foregoing descriptions. Although specific terms may be employed herein, they are used only in generic and descriptive sense and not for purposes of limitation. Accordingly, the present disclosure is not limited to the specific embodiments illustrated herein. While the above is a complete description of the preferred embodiments of the disclosure, various alternatives, modifications, and equivalents may be used. Therefore, the above description and the examples should not be taken as limiting the scope of the disclosure, which is defined by the appended claims.

The invention claimed is:

1. A decontamination facility for personnel and personal protective equipment (PPE), comprising:

one or more containers, wherein each container is a pre-existing shipping container, wherein one or more doors in the pre-existing shipping container are permanently closed by welding and removing one or more hinges and locking devices, wherein each container comprises:

(a) one or more pieces of decontamination and laundering equipment;

(b) a personnel shower, (c) one or more doors, wherein the doors are sized to allow the decontamination and laundering equipment to pass through easily;

(d) a hot water heater; and (e) a heating, ventilation and air conditioning (HVAC) system with heat recovery fresh air supply and a recirculating air filtration system, configured to provide a clean, climate controlled, atmosphere inside the container, and a riser system that is attached to a bottom of one or more corner supports to create a crawl space beneath the container, wherein the crawl space houses a wastewater collection and removal system, a tank, and an ejector pump to push wastewater to a sewer or septic system, wherein the container or a conjoined system of the container and riser are stackable and shippable via a rail.

2. The decontamination facility for personnel and personal protective equipment (PPE) of claim 1, wherein the containers are shipping containers, wherein the shipping containers are installed either permanently or temporarily.

3. The decontamination facility for personnel and personal protective equipment (PPE) of claim 1, wherein the containers are installed directly on a masonry foundation with a crawlspace and an access door.

4. The decontamination facility for personnel and personal protective equipment (PPE) of claim 1, wherein the riser system with a riser is engineered against lateral forces that occurs during transit and installation.

5. The decontamination facility for personnel and personal protective equipment (PPE) of claim 4, wherein the riser comprises an access hatch for performing maintenance and repair activities.

6. The decontamination facility for personnel and personal protective equipment (PPE) of claim 1, wherein the riser and the container are configured to provide support for external or internal insulation, and a sheathing and roof system.

7. The decontamination facility for personnel and personal protective equipment (PPE) of claim 1, wherein the container is fully wired to accommodate and power the decontamination and laundering equipment, one or more lights, and HVAC, and wherein one or more wires are connected through a waterproof service panel for electrical supply.

8. The decontamination facility for personnel and personal protective equipment (PPE) of claim 1, wherein the container is fully plumbed to accommodate the decontamination and laundering equipment, thereby providing water service through a water service fitting.

9. The decontamination facility for personnel and personal protective equipment (PPE) of claim 1, wherein the wastewater collection and removal system is comprised of piping sized to create a drainage reservoir that is commensurate on a maximum expected outflow of water from the facility.

10. The decontamination facility for personnel and personal protective equipment (PPE) of claim 1, wherein one or more pipes are installed along an interior perimeter of a space of the riser directly below a floor of the container.

11. The decontamination facility for personnel and personal protective equipment (PPE) of claim 1, wherein one or more pipes are plumbed through a floor to provide access to the decontamination and laundering equipment, and drain into the tank fitted with the ejector pump that allows the wastewater to be pumped to the sewer or septic system.

12. The decontamination facility for personnel and personal protective equipment (PPE) of claim 10, wherein the floor comprises one or more drains connecting the wastewater removal system and an entire drainage system.

13. The decontamination facility for personnel and personal protective equipment (PPE) of claim 10, wherein the floor is waterproofed with a multi-layered system to ensure its longevity.

14. The decontamination facility for personnel and personal protective equipment (PPE) of claim 1, wherein one container is attached to another container by using guides and fasteners, thereby allowing them to easily mate up and align with each other ensuring a secure connection.

* * * * *